US006523823B1

(12) United States Patent
Bakoledis

(10) Patent No.: US 6,523,823 B1
(45) Date of Patent: Feb. 25, 2003

(54) RACK AND PINION ADJUSTMENT MECHANISM

(75) Inventor: Andrew Bakoledis, Chester, CT (US)

(73) Assignee: GBR Systems Corp., Chester, CT (US)

( * ) Notice: Subject to any disclaimer, the term of this patent is extended or adjusted under 35 U.S.C. 154(b) by 102 days.

(21) Appl. No.: 09/842,759

(22) Filed: Apr. 27, 2001

(51) Int. Cl.[7] ..... B65H 31/20
(52) U.S. Cl. ..... 271/223; 271/220; 198/836.3
(58) Field of Search ..... 271/220–223; 198/836.3

(56) References Cited

U.S. PATENT DOCUMENTS

| | | | | |
|---|---|---|---|---|
| 635,177 | A | | 10/1899 | McCabe |
| 749,986 | A | | 1/1904 | Dick |
| 796,857 | A | | 9/1905 | Zander |
| 813,810 | A | | 2/1906 | Maynard |
| 2,262,510 | A | | 11/1941 | Morrison |
| 2,271,954 | A | | 2/1942 | Rockhill |
| 2,542,089 | A | | 2/1951 | Leifer |
| 2,588,917 | A | | 3/1952 | Geib |
| 2,626,149 | A | | 1/1953 | Holmberg |
| 2,651,244 | A | | 9/1953 | Ferguson |
| 2,785,893 | A | | 3/1957 | Ford |
| 2,836,416 | A | | 5/1958 | Man Marle |
| 3,102,627 | A | | 9/1963 | Acton |
| 3,220,605 | A | | 11/1965 | Casey |
| 3,339,916 | A | | 9/1967 | Tregay |
| 3,369,804 | A | * | 2/1968 | Schulze et al. ..... 271/17 |
| 3,406,964 | A | | 10/1968 | Eichorn |
| 3,713,651 | A | * | 1/1973 | Abler et al. ..... 271/221 |
| 3,857,559 | A | | 12/1974 | McInerny |
| 3,869,117 | A | | 3/1975 | Yoshimura |
| 3,933,350 | A | | 1/1976 | Mignano |
| 3,937,455 | A | | 2/1976 | Hauser |
| 4,114,870 | A | | 9/1978 | Di Blasi |
| 4,284,269 | A | | 8/1981 | Ignatjev |
| 4,607,831 | A | * | 8/1986 | Raybuck ..... 271/221 |
| 4,874,160 | A | | 10/1989 | Yamamoto |
| 4,907,792 | A | | 3/1990 | Washiashi |
| 4,908,673 | A | | 3/1990 | Muramatsu |
| 5,168,317 | A | | 12/1992 | Takano |
| 5,172,903 | A | | 12/1992 | Haneda |
| 5,322,160 | A | * | 6/1994 | Markiewicz et al. ..... 198/836.1 |
| 5,682,976 | A | * | 11/1997 | Jorgensen ..... 198/836.3 |
| 6,394,443 | B1 | * | 5/2002 | Vedoy et al. ..... 271/210 |

* cited by examiner

*Primary Examiner*—Christopher P. Ellis
*Assistant Examiner*—Mark A. Deuble
(74) *Attorney, Agent, or Firm*—Joseph J. Previto

(57) ABSTRACT

A sheet feeding mechanism comprising feeding sheets to an accumulating area. The accumulating area being at a first lateral plane and comprising spaced side rails at said first lateral plane. The accumulating area is between the side rails. The side rails are movable to a second lateral plane spaced from the first lateral plane. The distance between the side rails may be adjusted and after adjustment, the side rails are moved back to the first lateral plane.

17 Claims, 5 Drawing Sheets

RACK AND PINION ADJUSTMENT MECHANISM

BACKGROUND

The present invention relates to a sheet feeding mechanism and more particularly to rack and pinion adjustment mechanism for feeding sheets of different widths.

In current high speed sheet feeding mechanisms, sheets of paper are moved from one machine to another or from one portion of a machine to another portion. Sheets of different widths are usually fed at different times in the same machine. When a machine is to be changed from feeding sheets of one width to feeding sheets of another width, the machine is usually shut down and the necessary adjustments are made to permit the machine to feed sheets of a different width. Special tools may be needed to readjust the machine. This results in down-time for the machine and may require dismantling of the machine to readjust it to feed sheets of another width.

OBJECTS

The present invention overcomes these drawbacks and has for one of its objects the provision of an improved sheet feeding machine in which the width of paper being fed may be changed without dismantling the machine.

Another object of the present invention is the provision of an improved sheet feeding machine in which the width of the paper being fed may be changed without the use of special tools.

Another object of the present invention is the provision of an improved sheet feeding machine which requires very little down-time to adjust the machine to feed sheets of different widths.

Another object of the present invention is the provision of an improved sheet feeding machine which is simple to use.

Another object of the present invention is the provision of an improved sheet feeding machine which is inexpensive to manufacture and maintain.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for the purposes of illustration and description and is shown in the accompanying drawings forming a part of the specification, wherein.

DESCRIPTION

Figure 1:
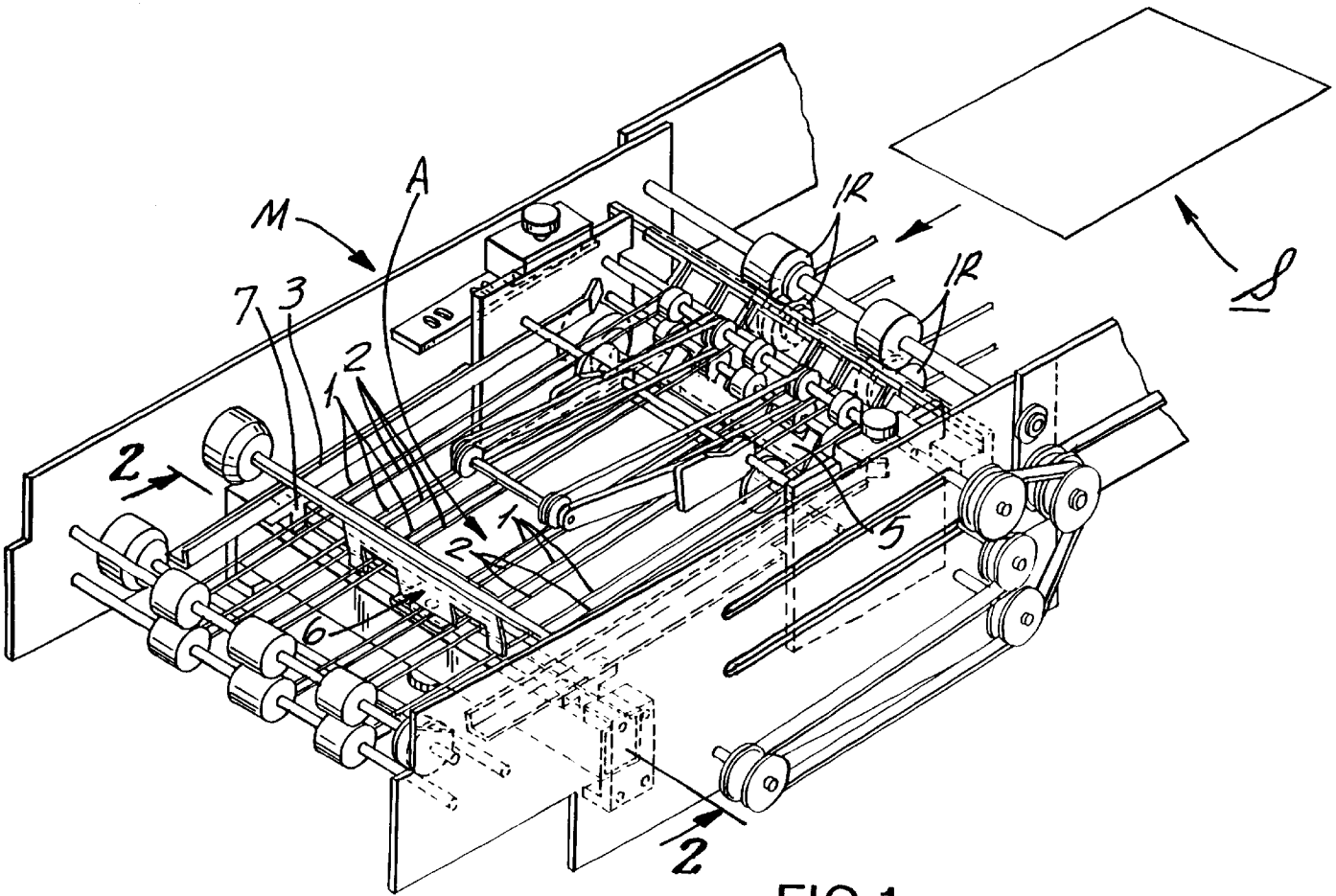
FIG. 1 is a perspective view of a machine in which the present invention may be used.

Referring to the drawing, sheets S are fed to the machine M from a source (not shown) by means of input rollers IR. The sheets S being fed are accumulated in an accumulating area A which comprises a plurality of pairs of superimposed stationary cables 1 and 2 and a pair of opposed adjustable guide rails 3 and 4 which are part of opposed adjustable rail assemblies 7 and 8. The sheets S are fed between the plurality of pairs of superimposed stationary cables 1 and 2 and between the laterally opposed adjustable side rails 3 and 4. The cables 1 and 2 are superimposed over each other so that they hold the stack of sheets S between them in the accumulating area A. A plurality of cable pairs 1–2 are distributed evenly across the accumulating area A between the side rails 3 and 4. In the drawings, six cable pairs 1–2 are shown evenly spaced between side rails 3–4. However, it will be understood that a greater or lesser number of cable pairs 1–2 may be used, without departing from the invention. After a sufficient number of sheets S have been accumulated in the accumulating area A, the stack of sheets S is moved out of the accumulating area A by means of a pushers 5 or 6 (which pivot back and forth) which push the stack of sheets S out of the accumulating area A through exit rollers ER.

The side rails 3 and 4 are adapted to be adjusted to the width of the sheets of paper S being accumulated and fed. The side rail assemblies 7 and 8 comprise the side rails 3 and 4, opposed movable blocks 9 and 10 on which side rails 3 and 4 are mounted, laterally spaced racks 15 and 16 extending from the blocks 9 and 10 in opposite directions toward each other and toothed pinion 17 mounted between the laterally spaced racks 15 and 16. Rotation of the pinion 17 in one direction or the other will move the racks 15 and 16 in one direction or the other to move the blocks 9 and 10 and the rails 3 and 4 either toward each other or away from each other.

The rail assemblies 7 and 8 are mounted on an adjustable support assembly 20 which extends across the width of the machine M. The support assembly 20 comprises lower platform 21, opposed side walls 22, over hanging top walls 23 and opposing end walls 24. The end walls 24 of the platform assembly 20 are mounted on spring assemblies 26. Each spring assembly 26 comprises a spring 25 mounted on a guide post 28 and opposed housings 29 within which the springs and guide post 28 are mounted.

Figure 6:
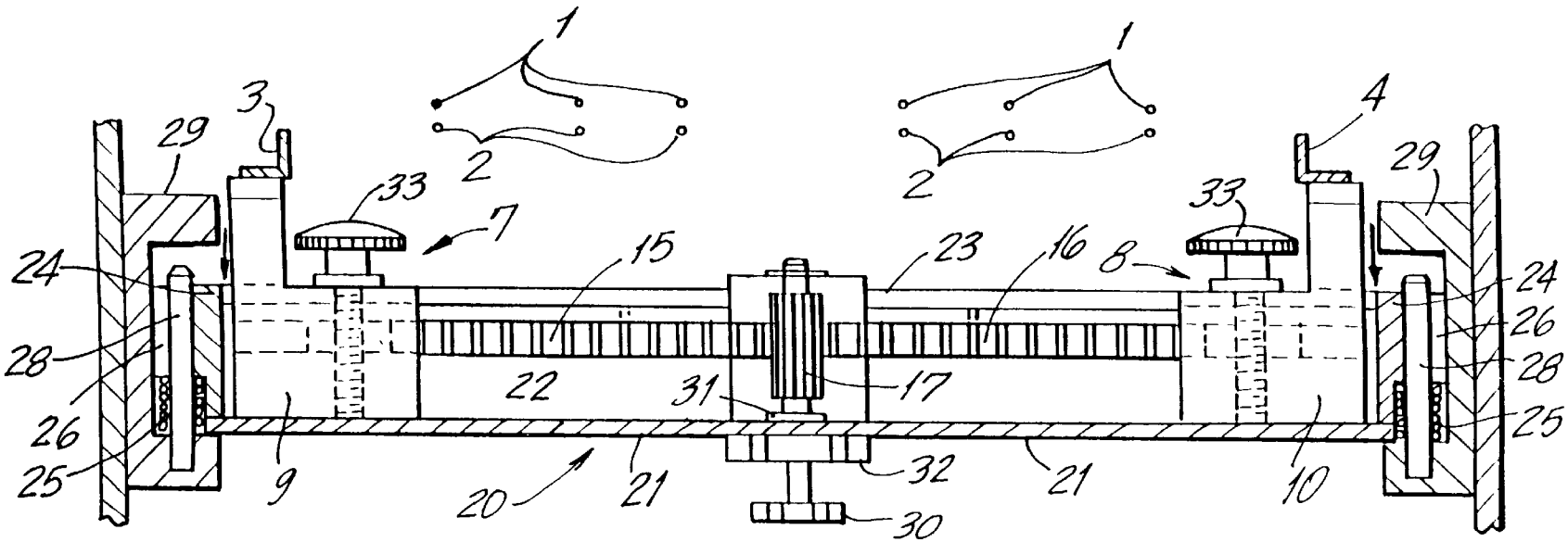
FIG. 6 is a sectional view similar to FIG. 2 showing the first step in converting the machine to feed sheets of different widths.
Figure 7:
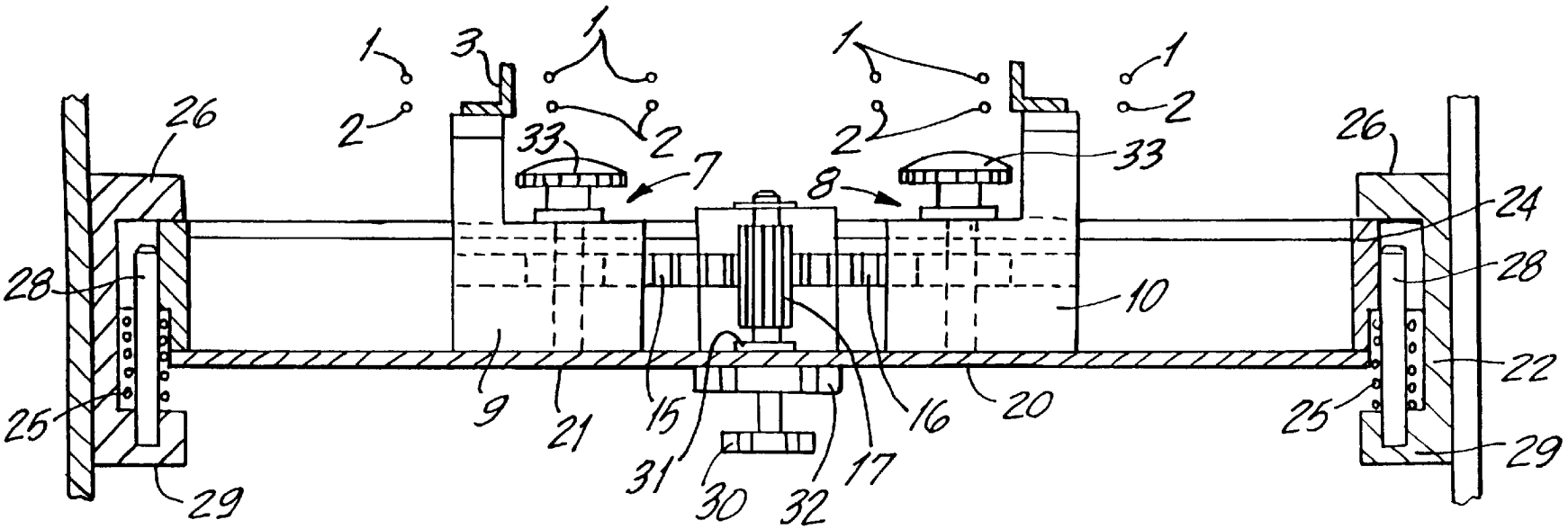
FIG. 7 is a sectional view similar to FIG. 2 showing the final step in converting the machine to feed sheets of different widths.

The pinion 17 for controlling the racks 15 and 16 has a knob 30 extending downwardly therefrom to a position below the support assembly 20. Rotation of the knob 30 will rotate the pinion 17 which in turn will move the racks 15 and 16, blocks 9 and 10 and side rails 3 and 4 back and forth. The knob 30 has a collar 31 on the inner surface of the lower platform 21 to permit the support assembly 20 to be lowered beneath its original level against the action of the springs 25 (FIG. 6). Upon release of the knob 30, the springs 25 will raise the support assembly 20 back to its original level.

The support assembly 20 is normally at a lateral level and plane at which the side rails 3–4 are laterally between and at the same level as cable pairs 1–2. The support assembly 20 may be lowered to a position whereby the side rails 3–4 are below the level or plane of the cable pairs 1–2. In the lowered position, the side rails 3 and 4 may then be moved toward and away from each other by rotating the knob 30 to adjust the distance between them and their lateral orientation with respect to the cable pairs 1–2. When the knob 30 is released, the springs 25 move the support assembly 20 as well as the rails 3–4 back to their original position on the same level and lateral plane as the cable pairs 1–2.

Figure 2:
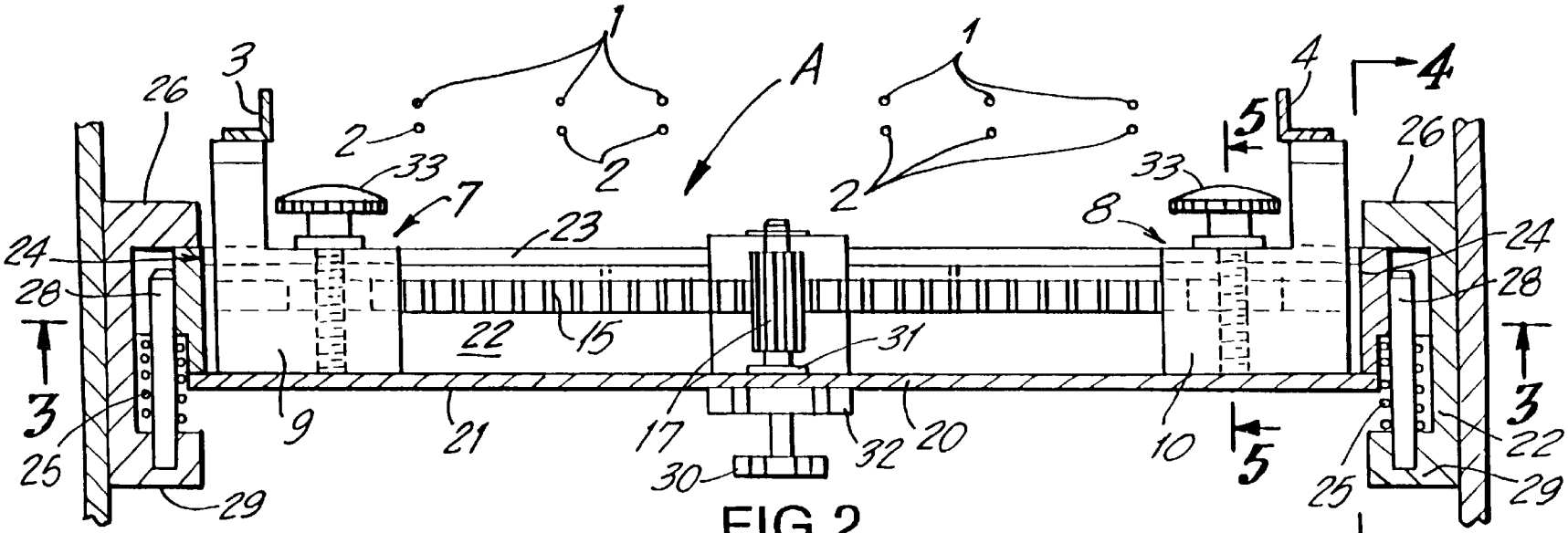
FIG. 2 is a sectional view taken generally along line 2—2 of FIG. 1.
Figure 3:
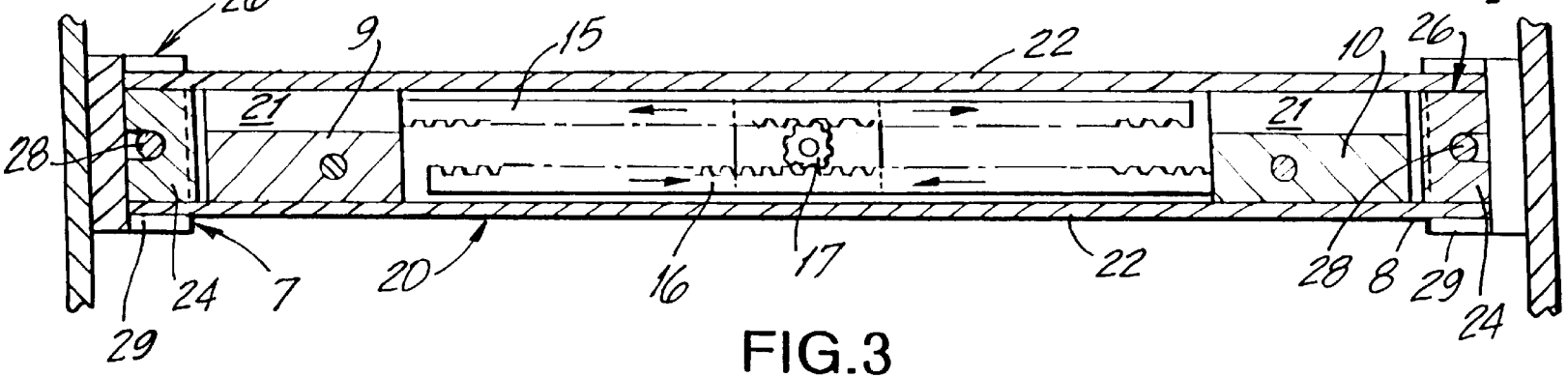
FIG. 3 is a sectional view taken generally along line 3—3 of FIG. 2.
Figure 4:
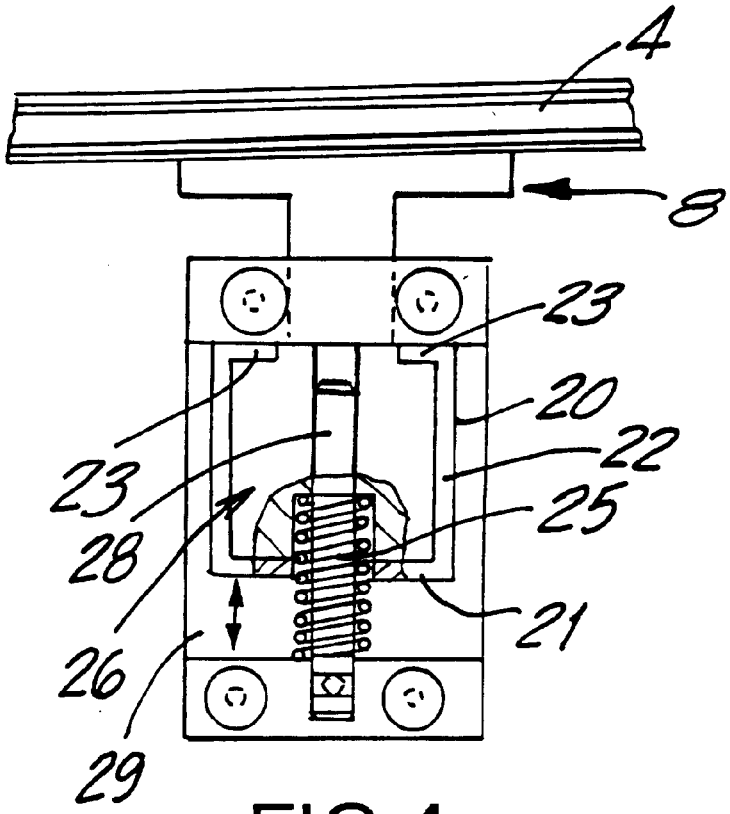
FIG. 4 is a side view partly in section taken generally along line 4—4 of FIG. 2.
Figure 5:
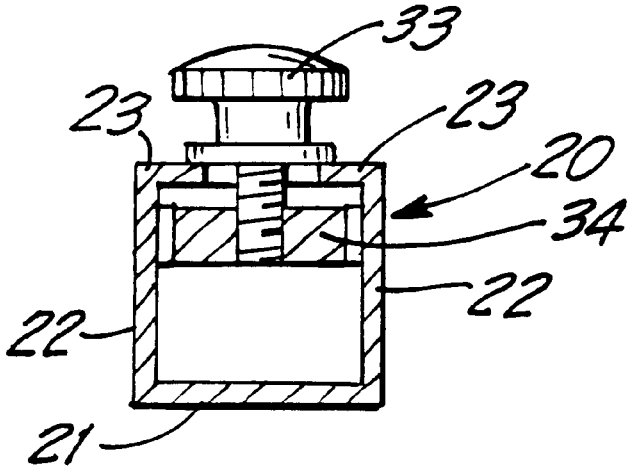
FIG. 5 is a sectional view taken generally along line 5—5 of FIG. 2.

In operation, sheets S of a certain width are fed between the side rails 3 and 4 and accumulate in the accumulating area A between rails 3–4 and between the laterally spaced superimposed cable pairs 1–2. The side rails 3 and 4 may be positioned as shown in FIG. 2 with all of the cable pairs 1–2 (six in the drawings) interposed in the space between side rails 3 and 4 with the side rails 3 and 4 being at the same level and lateral plane as the level and lateral plane of the cable pairs 1–2. If it is desired to feed sheets of a different (e.g. narrower) width, the knob 30 is grasped and the support assembly 20 (together with the rails 3 and 4, block assemblies 7 and 8, racks 15–16 and pinion 17) is moved down against the action of the springs 25 to a lower position whereby the side rails 3 and 4 are now below the level and lateral plane of the spaced cable pairs 1–2, as shown in FIG. 6. In this position, the knob 30 is rotated so that the pinion 17 moves the racks 15 and 16 and the side rails 3 and 4 closer to each other to a position where the rails 3–4 are laterally between the outer two pairs of cables 1–2 and the inner four pairs of cables 1–2. When this position is reached, the knob 30 is released and the springs 25 will move the support assembly 20 and the side rails 3 and 4 back to their original operating level and plane. However, the rails 3 and 4 are now closer to each other and are between the outer two cable pairs 1 and 2 and the inner four cable pairs 1–2 to permit narrower paper to be fed. In the example given herein, the side rails 3 and 4 are moved from a position outside of the six pairs of cables 1–2 to a position between two outer pair of cables 1–2 and the inner four pairs of cables 1–2. However, it will be understood that the side rails 3 and 4 may be moved to a position between the two innermost cable pairs 1–2 and the four outer pairs of cables 1–2 without departing from the The racks 5–6 and rails 34 may be locked in place by a lock nut 32 on the pinion knob 30. Alternately, or in addition thereto, threaded lock knobs 33 may be provided which are threadally tightened on each block 9–10 by tightening a T-nut clamp 34 against the underside of the over hanging top walls 23 of support assembly 20 in order to hold the blocks 9–10, the racks 15–16 and the rails 3–4 in position.

It will be seen that the present invention provides an improved sheet feeding mechanism in which the width of paper being fed may be changed without dismantling the machine in which the width of the paper being fed may be changed without the use of special tools, which requires very little down-time to adjust the machine to feed sheets of different widths, which is simple to use and inexpensive to manufacture and maintain.

As many and varied modifications of the subject matter of this invention will become apparent to those skilled in the art from the detailed description given hereinabove, it will be understood that the present invention is limited only as provided in the claims appended hereto.

What is claimed is:

1. A sheet feeding mechanism comprising means for feeding sheets to an accumulating area, said accumulating area being at a first lateral plane, said accumulating area comprising spaced side rails, said side rails being approximately at said first lateral plane, said accumulating area being between said side rails, means for moving said side rails to a second lateral plane spaced from said first lateral plane, means for adjusting the distance between said side rails and means for moving the side rails back to said first lateral plane.

2. A sheet feeding mechanism as set forth in claim 1, wherein said accumulating area comprises a plurality of laterally spaced pairs of superimposed cables which are positioned approximately at said first lateral plane and between which the sheets being fed are accumulated.

3. A sheet feeding mechanism as set forth in claim 2, wherein said cable pairs are superimposed over each other and wherein at least some of the cable pairs are mounted between said side rails and at said first lateral plane.

4. A sheet feeding mechanism as set forth in claim 3, wherein said side rails are adjustable from a first position where at least some of said cable pairs are between said side rails to a position where at least some of said cable pairs are outside of the side rails.

5. A sheet feeding mechanism as set forth in claim 4, wherein said side rails are mounted by support means.

6. A sheet feeding mechanism as set forth in claim 5, wherein said moving means are provided in operative association with said support means for moving said support means between said first and second lateral planes.

7. A sheet feeding mechanism as set forth in claim 6, wherein spring means are provided which are operatively associated with said support means.

8. A sheet feeding mechanism as set forth in claim 7, wherein said spring means are at opposed ends of said support means.

9. A sheet feeding mechanism as set forth in claim 8, wherein said side rails are mounted on block means on said support means and wherein adjusting means are provided to adjust said block means relative to each other.

10. A sheet feeding mechanism as set forth in claim 9, wherein said block means comprise spaced racks extending toward each other from opposite directions.

11. A sheet feeding mechanism as set forth in claim 10, wherein rack moving means are provided between said spaced racks to move the racks relative to each other.

12. A sheet feeding mechanism as set forth in claim 11, wherein said rack moving means comprise pinion means.

13. A sheet feeding mechanism as set forth in claim 12, wherein said moving means are mounted on said pinion means and adapted to be actuated in order to move the support means between said first and second lateral planes.

14. A sheet feeding mechanism as set forth in claim 13, wherein said moving means are knob means.

15. A sheet feeding mechanism as set forth in claim 14, wherein lock means are mounted on said knob means to lock the pinion and racks in position.

16. A sheet feeding mechanism as set forth in claim 15, wherein said block means have locking means which may be tightened to hold the racks in position.

17. A sheet feeding mechanism as set forth in claim 16, wherein said second lateral plane is lower than said first lateral plane.

* * * * *